US008602280B2

(12) United States Patent
Chang

(10) Patent No.: US 8,602,280 B2
(45) Date of Patent: Dec. 10, 2013

(54) ADHESIVE TAPE DISPENSER

(76) Inventor: Chi-Tsai Chang, Taichung (TW)

( * ) Notice: Subject to any disclaimer, the term of this patent is extended or adjusted under 35 U.S.C. 154(b) by 109 days.

(21) Appl. No.: 13/443,476

(22) Filed: Apr. 10, 2012

(65) Prior Publication Data

US 2012/0193389 A1 Aug. 2, 2012

Related U.S. Application Data

(63) Continuation-in-part of application No. 12/416,167, filed on Apr. 1, 2009, now abandoned.

(51) Int. Cl.
*B26F 3/02* (2006.01)

(52) U.S. Cl.
USPC ..... 225/43; 225/89

(58) Field of Classification Search
USPC ..... 225/19, 20, 89, 39, 43; D19/69, 70
See application file for complete search history.

(56) References Cited

U.S. PATENT DOCUMENTS

| | | | | | |
|---|---|---|---|---|---|
| 1,029,490 | A | * | 6/1912 | Connors | 225/43 |
| 2,295,477 | A | | 12/1940 | Jackson | |
| 2,333,378 | A | | 2/1942 | Jackson | |
| 2,709,049 | A | | 4/1951 | Weis | |
| 2,678,777 | A | * | 5/1954 | Donkin | 225/19 |
| 2,685,416 | A | * | 8/1954 | Smith | 83/649 |
| 2,924,365 | A | | 3/1956 | Dahlquist | |
| 2,798,552 | A | * | 7/1957 | Aldrich | 225/19 |
| 2,889,975 | A | * | 6/1959 | Hanlon | 225/19 |
| 3,034,691 | A | * | 5/1962 | Gershen | 225/25 |
| 3,067,514 | A | * | 12/1962 | Main | 30/124 |
| 3,132,783 | A | * | 5/1964 | Duncan | 225/25 |
| 3,281,033 | A | | 10/1966 | Stutzman et al. | |
| 3,349,979 | A | * | 10/1967 | Costello | 225/44 |
| 3,410,465 | A | * | 11/1968 | Costello | 225/65 |
| 3,502,252 | A | | 3/1970 | Mariani | |
| 3,930,697 | A | | 1/1976 | Barouh et al. | |
| 4,262,835 | A | * | 4/1981 | Wrobel | 225/25 |
| 4,417,677 | A | | 11/1983 | Mead | |
| 4,527,722 | A | | 7/1985 | Strachan | |
| 4,574,979 | A | | 3/1986 | Hackett | |
| 4,586,671 | A | | 5/1986 | Piana et al. | |
| 4,738,384 | A | | 4/1988 | Tigner | |
| 4,752,023 | A | | 6/1988 | Lin | |
| 4,793,537 | A | | 12/1988 | Amagaya | |
| 4,898,312 | A | | 2/1990 | Hwang | |
| 5,123,582 | A | | 6/1992 | Lo | |
| 5,133,980 | A | | 7/1992 | Ream et al. | |
| 5,154,336 | A | | 10/1992 | Ouellet | |
| 5,167,357 | A | | 12/1992 | Shih | |
| 5,294,068 | A | * | 3/1994 | Baro et al. | 242/588.6 |

(Continued)

*Primary Examiner* — Sean Michalski
(74) *Attorney, Agent, or Firm* — Muncy, Geissler, Olds & Lowe, PLLC

(57) ABSTRACT

An adhesive tape dispenser of the present invention includes a housing and a tape holder. The housing has an opening and a pivot axle disposed on the opening. The tape holder is received in the housing and has a pivot hole to receive the pivot axle. The housing and the tape holder have a limitation structure to enable the tape holder to pivot between a closed position and an open position. The housing has a pressing portion which is able to press the tape holder to cancel limitation of the limitation structure, and then the tape holder is able to pivot away from the opening freely to facilitate the replacement of tape roll. Thereby, the adhesive tape dispenser of the present invention can provide an easy way to operate, and the replacement of tape roll becomes more convenient.

6 Claims, 9 Drawing Sheets

(56) References Cited

U.S. PATENT DOCUMENTS

| | | | | |
|---|---|---|---|---|
| 5,494,204 | A | 2/1996 | Wang | |
| 6,293,452 | B1 | 9/2001 | Mandar | |
| D449,858 | S * | 10/2001 | Liu | D19/69 |
| 6,659,322 | B1 | 12/2003 | De Man et al. | |
| 6,712,113 | B1 * | 3/2004 | Peggion | 156/577 |
| 7,175,062 | B2 | 2/2007 | Shah | |
| 7,178,707 | B1 | 2/2007 | Bokina | |
| D592,249 | S * | 5/2009 | Chang | D19/69 |
| D656,548 | S * | 3/2012 | Packard et al. | D19/69 |
| D656,549 | S * | 3/2012 | Packard et al. | D19/69 |
| 2002/0079344 | A1 * | 6/2002 | Pitzen et al. | 225/20 |
| 2006/0076383 | A1 * | 4/2006 | Dickie | 225/39 |
| 2011/0114689 | A1 | 5/2011 | Liu | |
| 2012/0193389 | A1 * | 8/2012 | Chang | 225/43 |
| 2012/0305617 | A1 * | 12/2012 | Kuehn et al. | 225/39 |

* cited by examiner

ADHESIVE TAPE DISPENSER

The present invention is a continuation-in-part of application Ser. No. 12/416,167, filed Apr. 1, 2009 now abandoned, the entire contents of which are hereby incorporated by reference.

BACKGROUND OF THE INVENTION

1. Field of the Invention
2. Description of the Prior Art

Conventional adhesive tape dispenser are disclosed in patents U.S. Pat. Nos. 2,709,049, 4,752,023, 5,167,357, and 7,175,062. This kind of tape dispensers are disadvantageous that the adhesive face of tape located between the blade and the tape axle is usually contaminated by dust. Also, the blade is exposed outside directly to be possible to hurt a user accidentally.

To solve the problem of exposedness of the blade and the tape, a protection cover is usually disposed on the outside of the blade to conceal the blade and the tape selectively, as disclosed in patents U.S. Pat. Nos. 2,678,777, 2,924,365, 3,034,691, and 4,262,835. However, the tape dispenser with a protection cover is too complicated structurally, and the protection cover hampers the operation. Furthermore, the tape rolls of the tape dispensers mentioned above are difficult to be replaced. More specifically, the tape dispenser has to be disassembled before replacement of the tape roll. Although another cover disposed on a lateral side to facilitate the replacement of tape roll is disclosed in patent U.S. Pat. No. 5,133,980, it means that manufacturers must manufacture two covers to conceal the blade and to facilitate replacement of tape roll respectively. The cost is increased, and also the appearance of the tape dispenser is unattractive.

The present invention is, therefore, arisen to obviate or at least mitigate the above mentioned disadvantages.

SUMMARY OF THE INVENTION

The main object of the present invention is to provide an adhesive tape dispenser which is able to prevent the cutter from hurting a user and to prevent the tape from contaminated, and replacement of tape roll is easier.

To achieve the above and other objects, an adhesive tape dispenser of the present invention includes a housing and a tape holder.

The housing has a first wall, an opposite second wall, and a cavity between the first and the second walls. The second wall has a sliding axle protruding toward the cavity and a pressing portion which is able to protrude toward the cavity. The housing forms an opening between the first and the second walls, and a pivot axle is disposed on the opening. The pivot axle partitions the opening into a first opening and a second opening.

The tape holder is received in the cavity and has a first face and an opposite second face. The first face faces the first wall, and the second face faces the second wall. The first face has a tape axle, and a longitudinal direction is perpendicular to the first face. The second face has a first limiting piece and a second limiting piece, and extending directions of the first and the second limiting pieces are parallel to the second face. A sliding slot is defined between the first and the second limiting pieces to enable the sliding axle to slide inside. The first limiting piece has a fixed first end and a free second end, and the second limiting piece has a free third end and a fixed fourth end. The first end corresponds to the third end positionally, and the second end corresponds to the fourth end positionally. The tape holder has a lateral face between the first face and the second face. The lateral face has a pivot hole to receive the pivot axle to enable the tape holder to pivot relative to the housing. The lateral face has a pressing end and an opposite cutting end wherein the pressing end is able to pivot toward inside of the first opening and the cutting end is able to pivot away from the second opening. A terminal end of the cutting end has a cutter.

Besides, the sliding slot has a receiving portion at the second end of the first limiting piece and the fourth end of the second limiting piece. When the sliding axle is located on the receiving portion, a width of the receiving portion is larger than widths of parts of the sliding slot except the receiving portion. When the sliding axle moves toward the first end of the first limiting piece and the third end of the second limiting piece, the sliding axle is able to press the first and the second limiting pieces away from the sliding slot to broaden the widths of the sliding slot. Thereby, the sliding axle is able to be positioned at any position in the sliding slot due to the clamping of the first and the second limiting pieces.

Due to the limitation to the sliding axle by the sliding slot, the tape holder is able to pivot between a closed position and an open position. When the tape holder is at the closed position, the opening is covered by the lateral face of the tape holder. On the contrary, when the tape holder is at the open position, the sliding axle abuts against a blocking portion of the third end of the second limiting piece. At the same time, the pressing end enters inside of the first opening, and the cutting end is away from the second opening. When the tape holder is at the open position and the pressing portion protrudes toward the cavity, the third end of the second limiting piece moves toward the first wall of the housing under the pressing of pressing portion. Hence, the cutting end is able to pivot away from the second opening further to expose the tape axle outside of the second opening.

Thereby, the adhesive tape dispenser of the present invention can provide an easy way to operate. More specifically, when the tape holder is at the closed position, the cutter can be concealed to prevent from hurting a user, and the tape is also concealed to prevent from being contaminated. On the other hand, the tape holder is abele to pivot to at most the open position for availability of the tape by the pressing the pressing end. Moreover, when the tape holder is at the open position and the pressing portion is pressed or pushed, the tape holder is able to pivot away from the second opening further to expose the tape axle outside of the second opening. Thus, replacement of tape can be easily achieved without any disassembling step.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
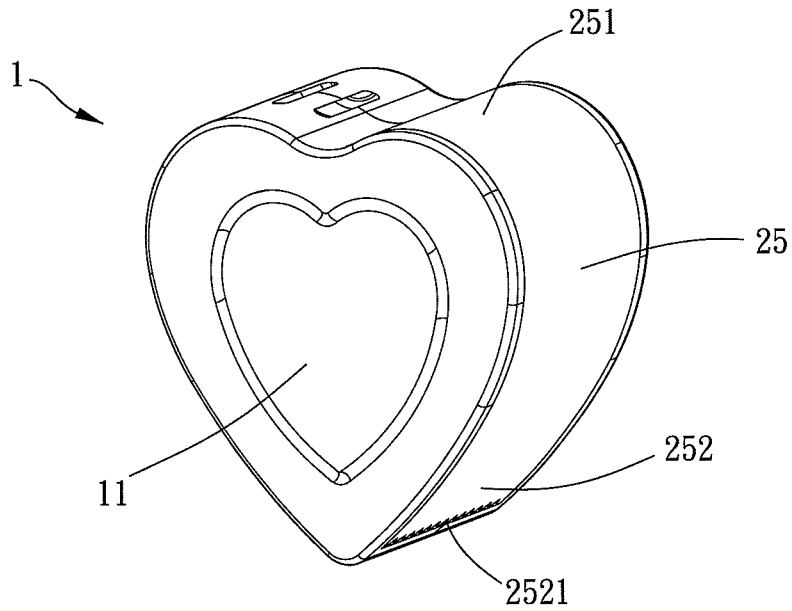
FIGS. 1 and 2 are stereogram drawings showing an adhesive tape dispenser of the present invention.
Figure 2:
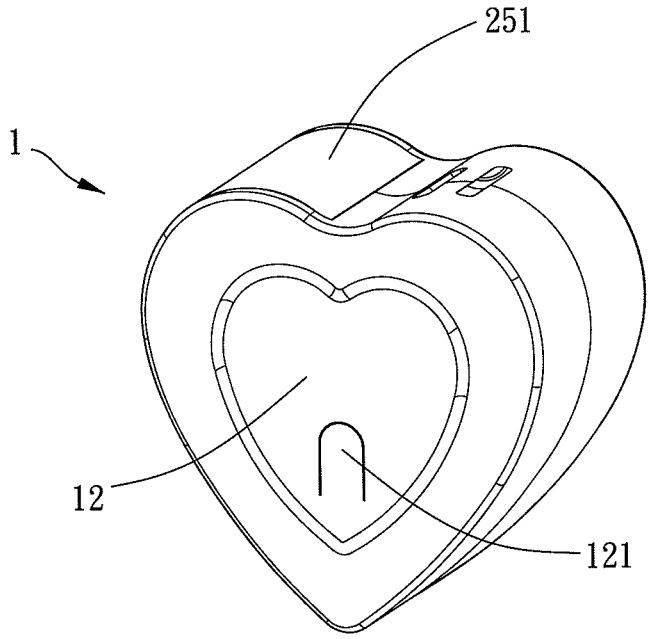
Figure 3:
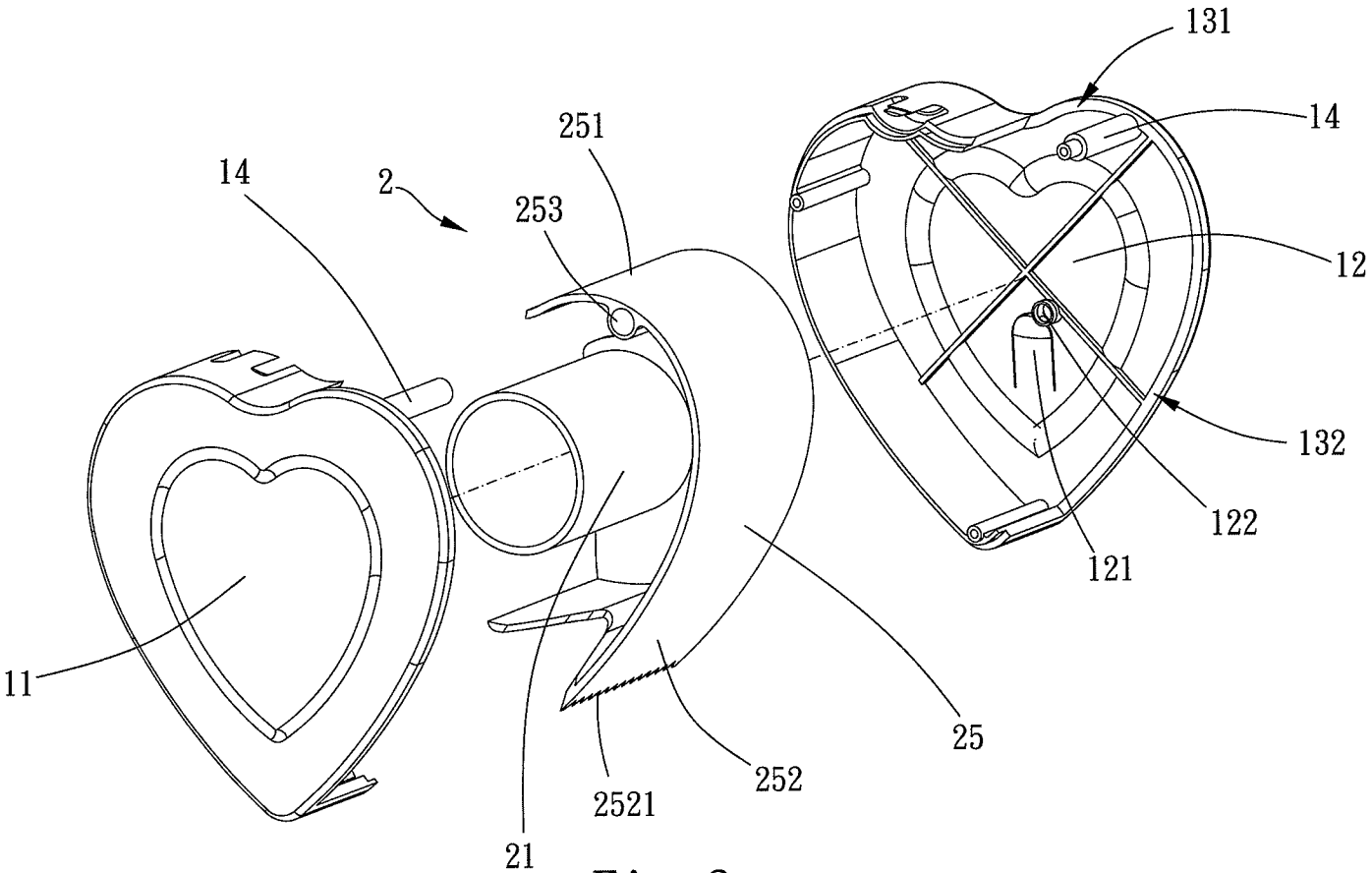
FIGS. 3 and 4 are breakdown drawings showing an adhesive tape dispenser of the present invention.

Please refer to FIG. 1 to FIG. 8 for a major embodiment of the present invention. The adhesive tape dispenser of the present embodiment includes a housing 1 and a tape holder 2.

The housing 1 has a first wall 11, an opposite second wall 12, and a cavity between the first wall 11 and the second wall 12. The second wall 12 has a sliding axle 122 protruding toward the cavity and a pressing portion 121 which is able to protrude toward the cavity. More preferably, the pressing portion 121 is an elastic piece. The housing 1 forms an opening 13 located between the first wall 11 and the second wall 12. The housing also has pivot axle 14 disposed on the opening 13, and a longitudinal direction of the pivot axle 14 is perpendicular to the first wall 11 and the second wall 12. The pivot axle 14 partitions the opening 13 into a first opening 131 and a second opening 132.

The tape holder 2 is received in the cavity and has a first face and an opposite second face. The first face faces the first wall 11, and the second face faces the second wall 12. The first face has a tape axle 21 which has a longitudinal direction perpendicular to the first face. The second face has a first limiting piece 22 and a second limiting piece 23. A sliding slot 24 is defined between the first and the second limiting pieces 22,23 to enable the sliding axle 122 to slide inside. The first limiting piece 22 has a fixed first end and a free second end, and the second limiting piece 23 has a free third end and a fixed fourth end. The first end corresponds to the third end positionally, and the second end corresponds to the fourth end positionally. The tape holder 2 has a lateral face 25, and the lateral face 25 has a pivot hole 253 to receive the pivot axle 14 to enable the tape holder 2 to pivot relative to the housing 1. The lateral face 2 has a pressing end 251 and an opposite cutting end 252. The pressing end 251 is able to pivot toward inside of the first opening 131, and the cutting end 252 is able to pivot away from the second opening 132. The cutting end 252 has a cutter 2521 corresponding to an edge of the second opening 132 away from the first opening 131 positionally. More preferably, the cutter 2521 has a saw-tooth edge.

Figure 7:
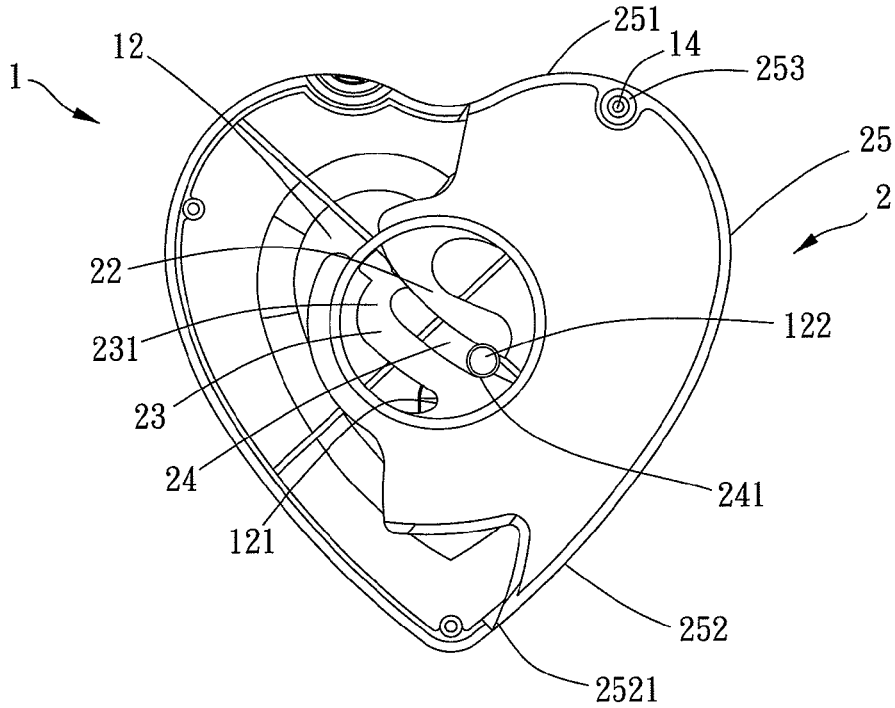
FIGS. 7 to 10 are illustrations of operation of an adhesive tape dispenser of the present invention.
Figure 8:
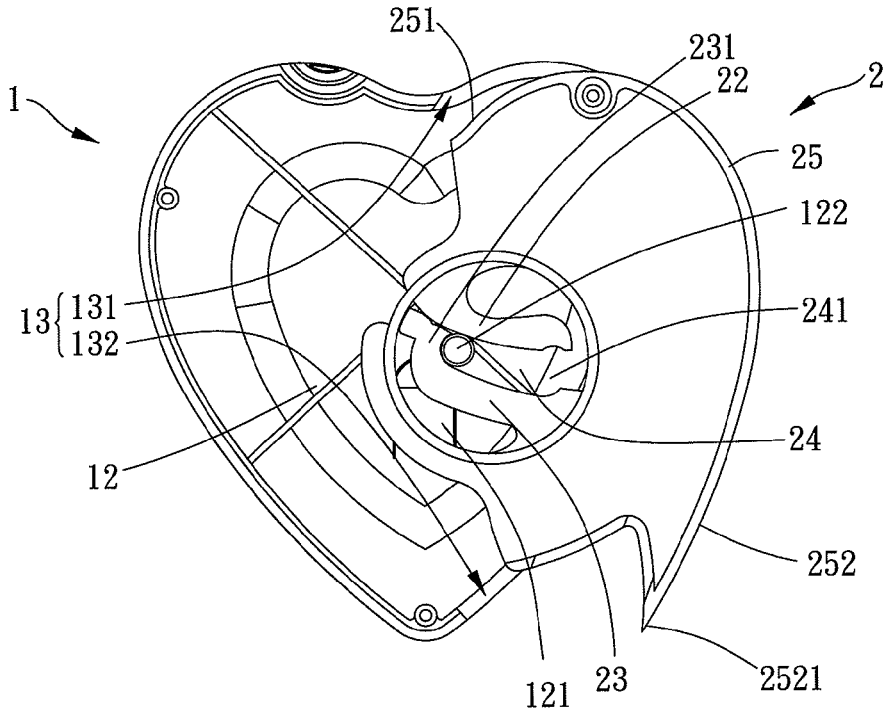
Figure 9:
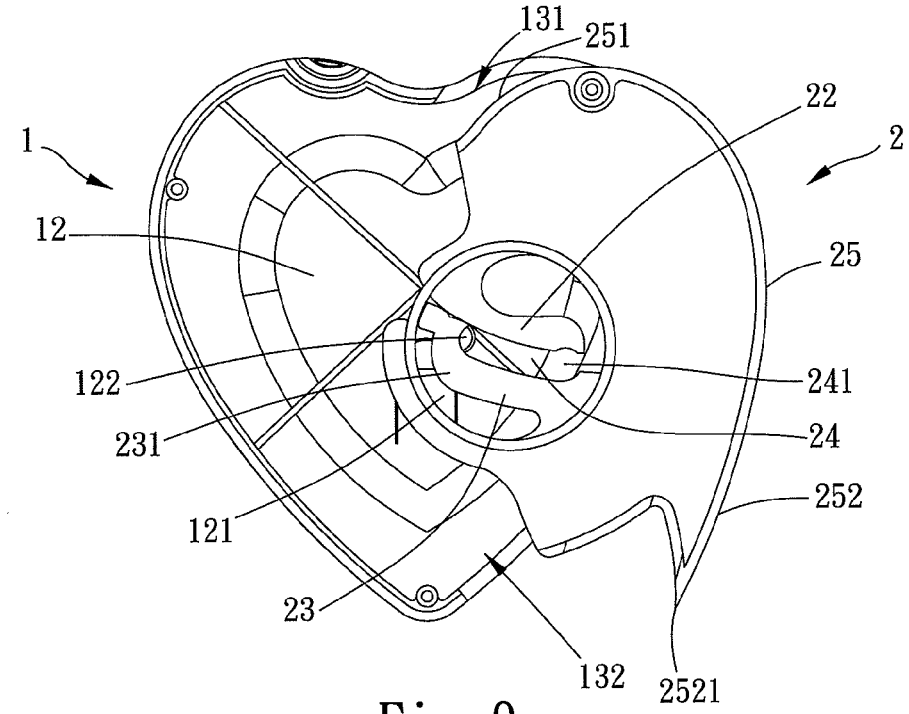
Figure 10:
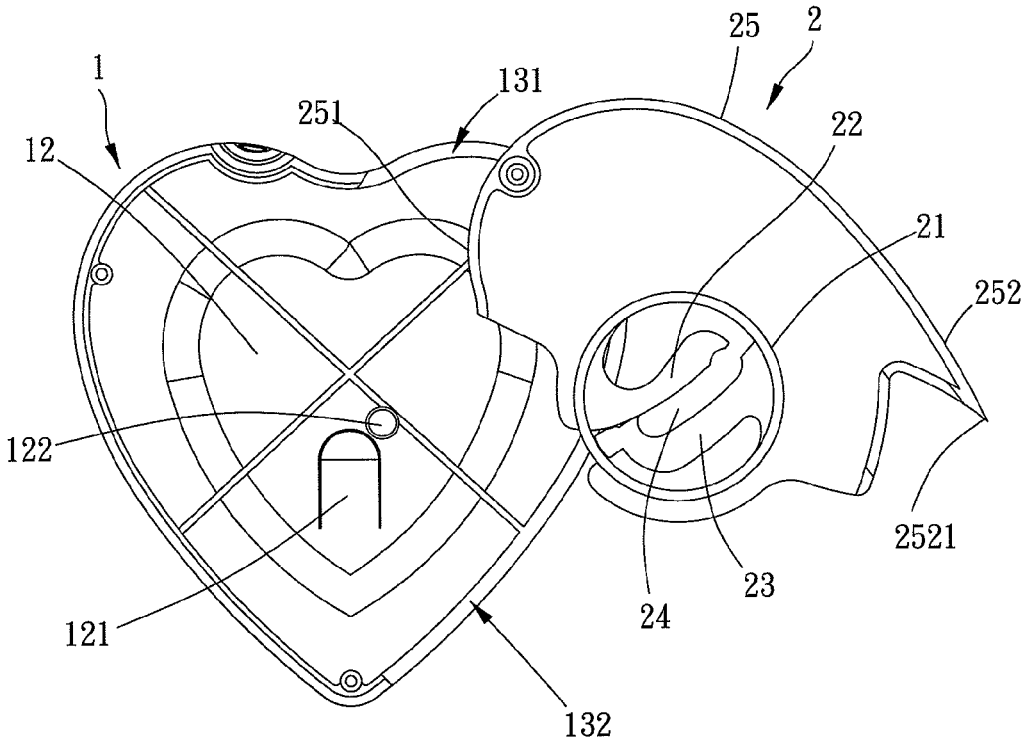
Figure 11:
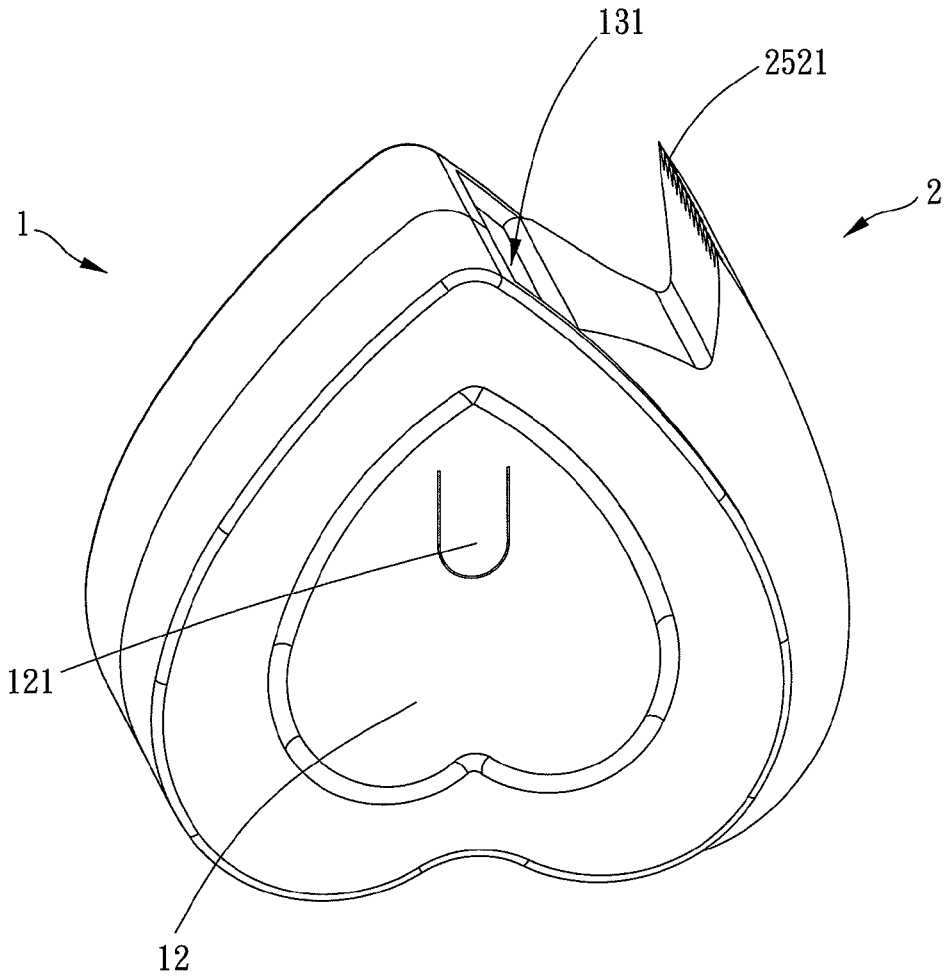
FIG. 11 is a stereogram drawing showing an adhesive tape dispenser of the present invention.

Please refer to FIG. 7 to FIG. 10 now, due to the limitation to the sliding axle 122 by the sliding slot 24, the tape holder 2 is able to pivot between a closed position and an open position. When the tape holder 2 is at the closed position, the lateral face 25 covers the opening 13, and the tape holder 2 is completely located in the housing 1. Of course, the tape axle 21 and the cutter 2521 are both concealed in the cavity, as shown in FIG. 7. When the sliding axle 122 abuts against a blocking portion 231 of the third end of the second limiting piece 23, the tape holder 2 is at the open position. At the same time, the pressing end 251 enters the inside of the first opening 131, and the cutting end 252 leaves the second opening 132 outward. Thus, the cutter 2521 leaves the cavity and is exposed outside of the housing 1, as shown in FIG. 8. On the other hand, when the pressing portion 121 protrudes toward the cavity, the third end of the second limiting piece 23 is pushed to move toward the first wall 11 of the housing 1 by the pressing portion 121. Hence, the sliding axle 122 is not blocked by the blocking portion 231 and is able to leave the sliding slot 24. Thus, the cutting end 252 is able to pivot away from the second opening 132 further, and the tape axle 21 can leave the cavity to be exposed outside of the housing 1, as shown in FIG. 9 and FIG. 10. In the major embodiment, the slot 24 has a receiving portion 241 at the second end of the first limiting piece 22 and the fourth end of the second limiting piece 23. When the sliding axle 122 is located on the receiving portion 241, a width of the receiving portion 241 is larger than widths of parts of the slot 24 except the receiving portion 241. When the sliding axle 122 moves toward the first end of the first limiting piece 22 and the third end of the second limiting piece 23, the sliding axle 122 is able to push the first and the second limiting pieces 22,23 away from the slot 24 and to broaden the widths of the slot 24 to clamp and position the sliding axle 122 at any position in the sliding slot 24.

Figure 4:
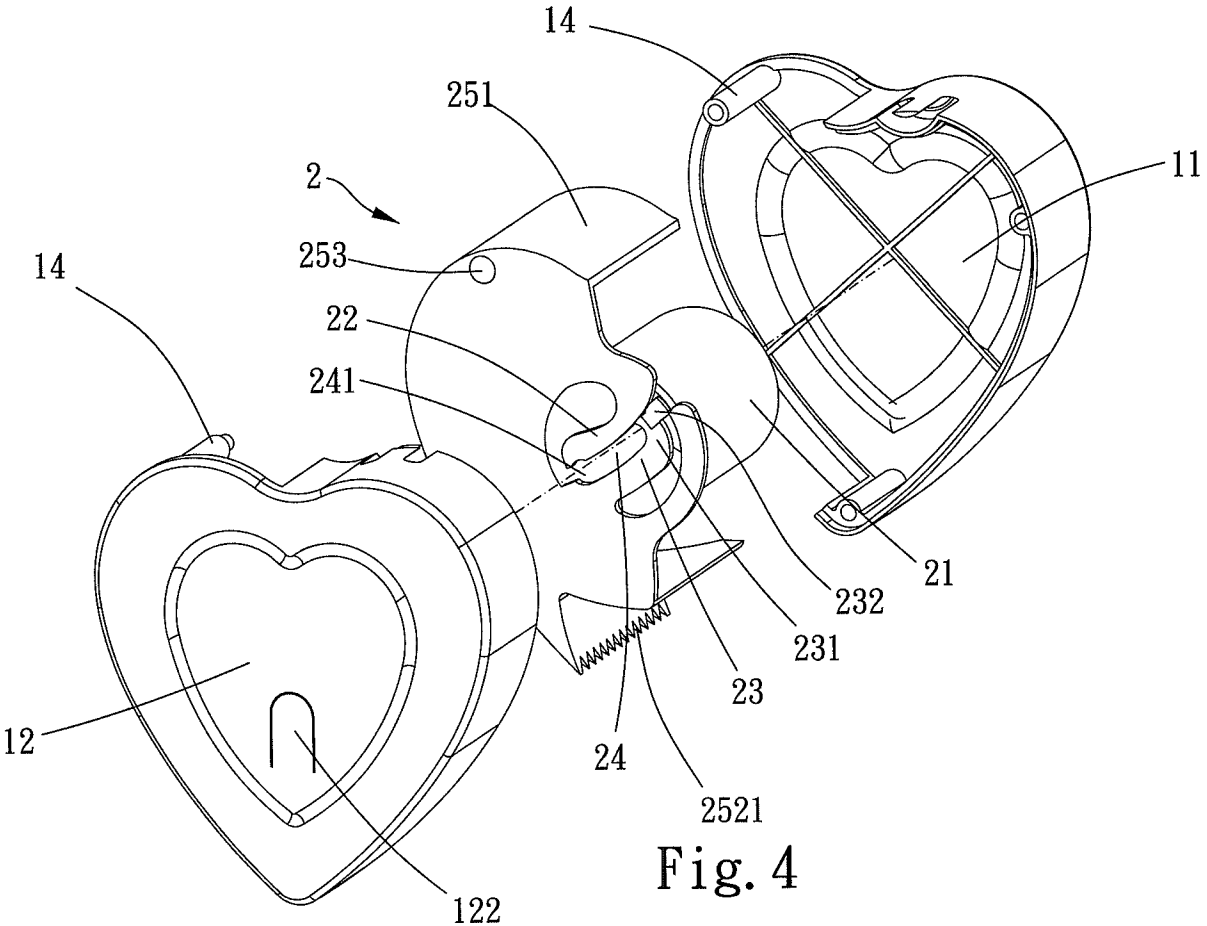
Figure 5:
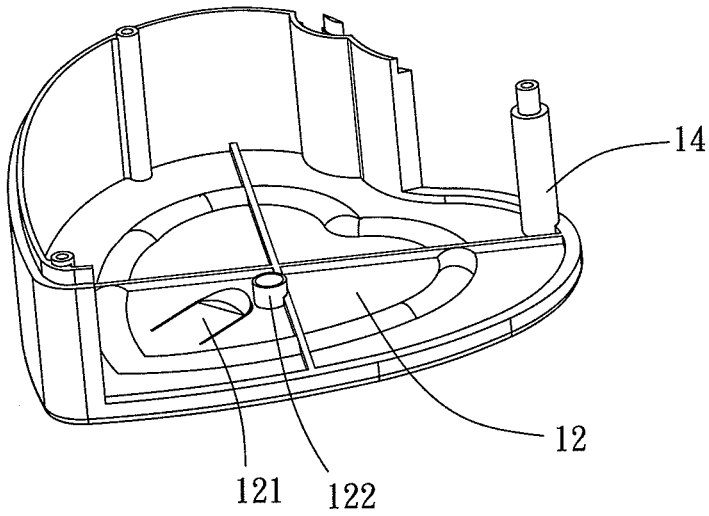
FIG. 5 is a partial stereogram drawing showing a housing of an adhesive tape dispenser of the present invention.
Figure 6:
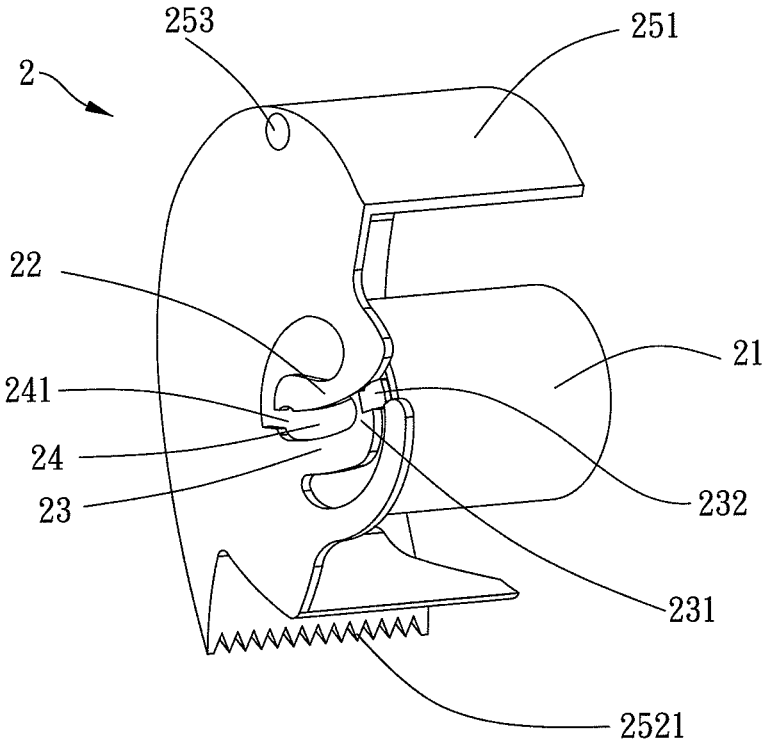
FIG. 6 is a stereogram drawing showing a tape holder of an adhesive dispenser of the present invention.
Figure 12:
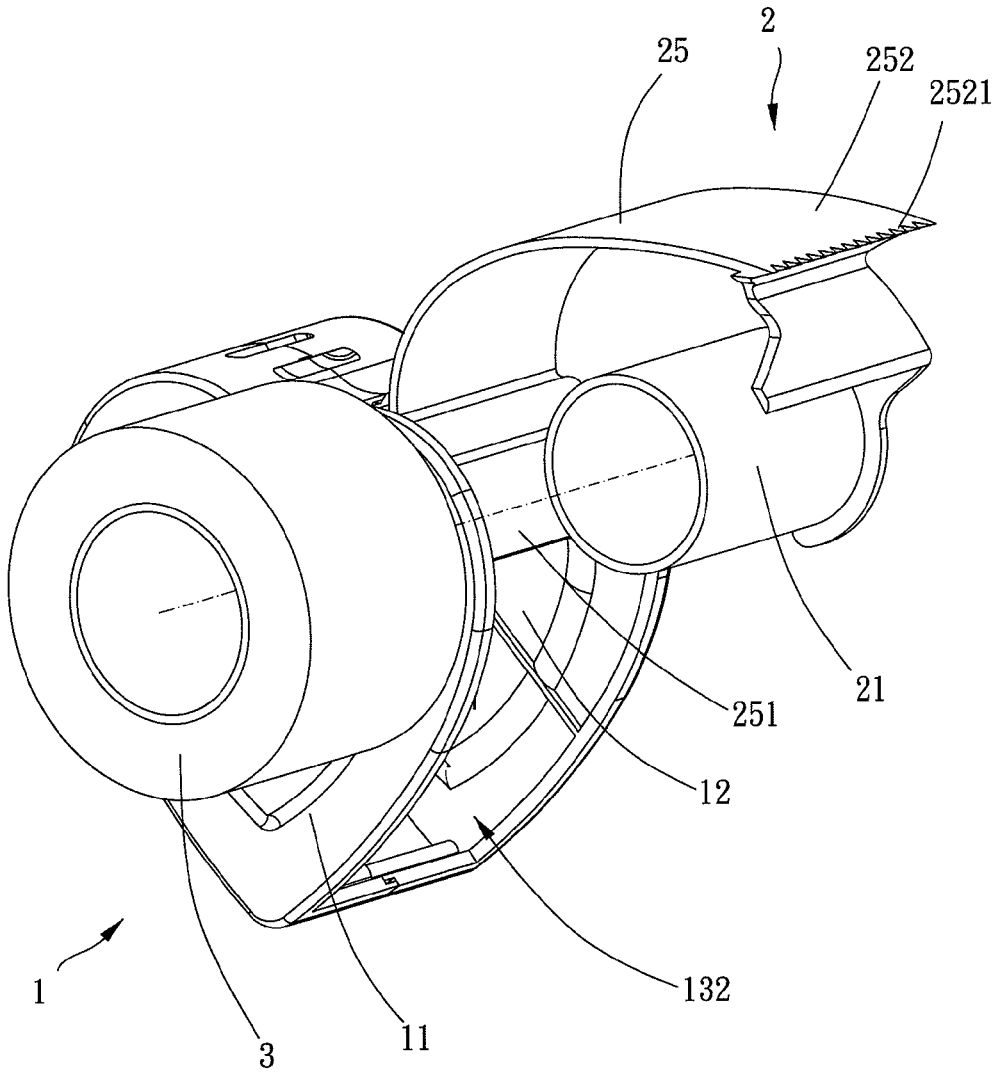
FIGS. 12 and 13 are illustrations of operation of an adhesive tape dispenser of the present invention.
Figure 13:
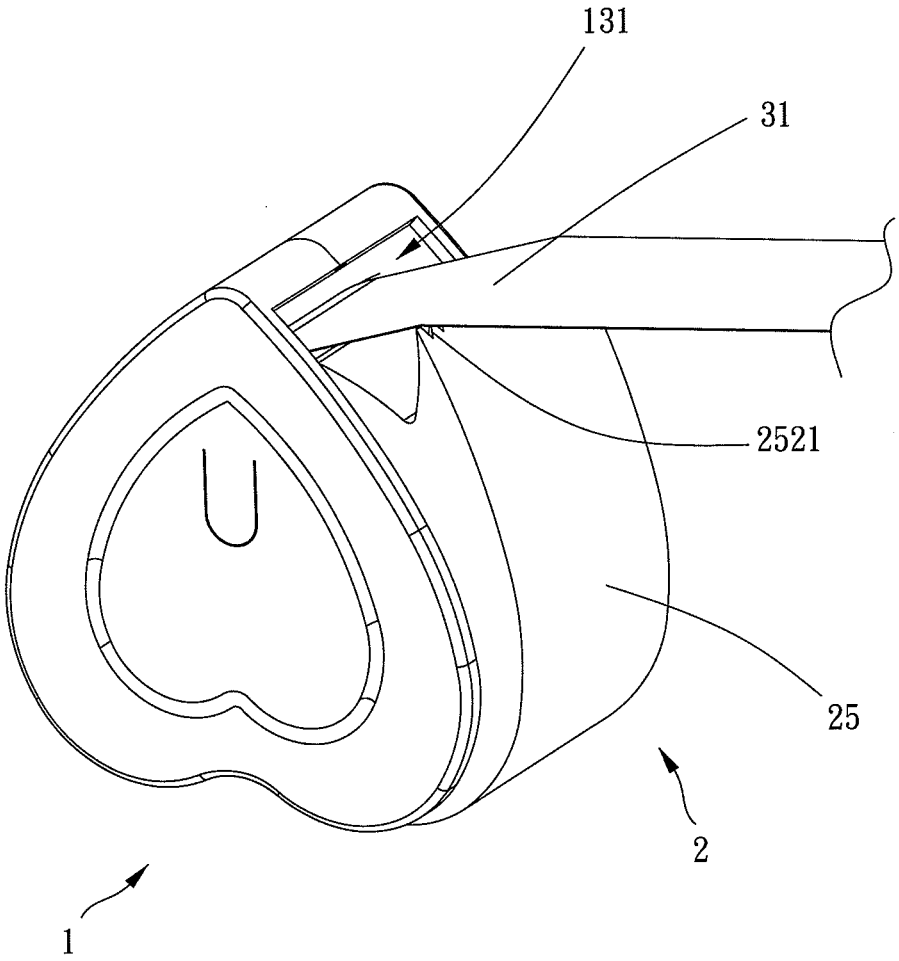

Practical operations are shown in FIG. 7 to FIG. 13. First, please refer to FIG. 7, when the tape holder 2 is at the closed position, the cutter 2521 and tape on the tape axle 21 are located in the cavity, and the opening 13 is completely covered by the lateral face 25 to protect the tape from contamination. Moreover, the sliding axle 122 is clamped by the first and the second limiting pieces 22,23, so that the tape holder 2 won't pivot freely without any operation by a user to keep staying at the closed position. Now please refer to FIGS. 8, 11, and 13, when the pressing end 251 is pushed by a user with fingers, the pressing end 251 pivots toward inside of the first opening 131, and the cutting end 252 pivots away from the second opening outward. At the same time, the tape holder 2 is at the open position, and the cutter 2521 and part of tape 31 are exposed outside of the cavity to be available for using. Besides, the sliding axle 122 is blocked by the blocking portion 231, so the cutting end 252 won't pivot away from the second opening 132 further. Thereby, a user can hold the housing 1 with one hand and reach the tape 31 with the other hand. After using, a user can push the cutting end 252 to pivot toward inside of the second opening 132, and then the tape holder can return to the closed position. Referring to FIGS. 9, 10, and 12, if a user need to replace the tape roll 3 with a new one, he can push the pressing portion 121 to move the third end of the second limiting piece 23 toward the first wall 11 of the housing 1. When a distance between the blocking portion 231 and the first wall 11 is smaller than a distance between a top end of the sliding axle 122 and the first wall 11, the sliding axle 122 is not blocked by the blocking portion 231 and is able to leave the sliding slot 24. Thus, the cutting end 252 can pivot away from the second opening 132 outward further, and then the tape axle 21 is exposed outside of the housing 1 to be available for replacement of tape rolls. After replacement, a user can push the cutting end 252 inward toward the second opening 132. More preferably, a face toward the second wall 12 of the third end of the second limiting piece 23 has an incline 232, as shown in FIG. 4 and FIG. 6. Thus, the sliding axle 122 can be guided into the sliding slot 24 by the incline 232, and the tape holder 2 is able to return to the closed position.

To conclude, the adhesive tape dispenser of the present invention is able to conceal the cutter and the tape to prevent from danger and contamination. Also, the tape can be easily reached by pressing the pressing end, and the tape holder won't pivot freely between the open and the closed positions to cause inconvenience. The most important is that the tape holder and the housing don't have to be dissembled before replacement of tape rolls. On the contrary, the tape axle can be exposed outside of the housing to be available for replacement of tape rolls when the pressing portion is pushed to release the sliding axle from the sliding slot. After replacement, the tape holder can be pushed back to the cavity easily. In brief, the adhesive tape dispenser of the present invention is easy for using, has a simple structure, and is also low-cost.

What is claimed is:

1. An adhesive tape dispenser, including:

a housing, the housing having a first wall, an opposite second wall, and a cavity between the first and the second walls, the second wall having a sliding axle protruding toward the cavity and a pressing portion which is able to protrude toward the cavity, the housing having an opening located between the first wall and the second wall, the housing also having a pivot axle disposed at the opening, a longitudinal direction of the pivot axle being perpendicular to the first and the second walls, the pivot axle partitioning the opening into a first opening and a second opening;

a tape holder, being received in the cavity and having a first face and a opposite second face, the first face facing the first wall, the second face facing the second wall, the first face having a tape axle, a longitudinal direction of the tape axle being perpendicular to the first face, the second face having a first limiting piece and a second limiting piece, a sliding slot being defined between the first and the second limiting pieces to enable the sliding axle to slide inside, the first limiting piece having a fixed first end and a free second end, the second limiting piece having a free third end and a fixed fourth end, the first end corresponding to the third end positioninally, the second end corresponding to the fourth end positionally, the tape holder having a lateral face between the first and the second faces, the lateral face having a pivot hole to receive the pivot axle to enable the tape holder to pivot relative to the housing, the lateral face having a pressing end and an opposite cutting end, the pressing end being able to pivot toward inside of the first opening, the cutting end being able to pivot away from the second opening, a cutter being disposed at an end of the cutting end;

wherein the tape holder is able to pivot between a closed position and an open position due to limitation of the sliding slot to the sliding axle;

wherein when the tape holder is at the closed position, the lateral face covers the opening, the tape holder is located in the cavity completely;

wherein when the tape holder is at the open position, the sliding axle abuts against a blocking portion of the third end of the second limiting piece, the pressing end enters the first opening, the cutting end leaves the second opening;

wherein when the tape holder is at the open position and the pressing portion protrudes toward the cavity, the third end of the second limiting piece is pressed by the pressing portion to move toward the first wall of the housing, the sliding axle is thereby not blocked by the blocking portion and is able to leave the sliding slot to enable the cutting end to pivot away from the second opening further.

2. The adhesive tape dispenser of claim 1, wherein the sliding slot has a receiving portion at the second end of the first limiting piece and the fourth end of the second limiting piece, a width of the receiving portion is larger than widths of other parts except the receiving portion of the sliding slot when the sliding axle is located on the receiving portion, the sliding axle is able to press the first and the second limiting pieces away from the sliding slot to broaden the widths of the slot when the sliding axle moves toward the first end of the first limiting piece and the third limiting piece.

3. The adhesive tape dispenser of claim 1, wherein the cutter has a saw-tooth edge.

4. The adhesive tape dispenser of claim 1, wherein the pressing portion is an elastic piece which is able to protrude toward the cavity.

5. The adhesive tape dispenser of claim 1, wherein the tape holder is able to pivot to expose the tape axle outside of the second opening.

6. The adhesive tape dispenser of claim 1, wherein the cutter corresponds to an edge of the second opening positionally.

* * * * *